US005918874A

United States Patent [19]

Armstrong et al.

[11] Patent Number: 5,918,874

[45] Date of Patent: Jul. 6, 1999

[54] TRAY FOR NARROW AND NORMAL WIDTH SHEETS

[75] Inventors: Daniel Eugene Armstrong, Versailles; Daniel Paul Cahill, Verona, both of Ky.

[73] Assignee: Lemark International, Inc., Lexington, Ky.

[21] Appl. No.: 09/096,398

[22] Filed: Jun. 11, 1998

[51] Int. Cl.[6] ..... B65H 3/06; B65H 3/52

[52] U.S. Cl. ..... 271/117; 271/121

[58] Field of Search ..... 271/117, 118, 271/161, 167, 171, 145, 121

[56] References Cited

U.S. PATENT DOCUMENTS

| | | | |
|---|---|---|---|
| 5,364,087 | 11/1994 | Schieck et al. | 271/148 |
| 5,384,631 | 1/1995 | Matsunami | 355/308 X |
| 5,520,381 | 5/1996 | Lo et al. | 271/117 |
| 5,527,026 | 6/1996 | Padget et al. | 271/21 |
| 5,575,467 | 11/1996 | Williams | 271/122 |
| 5,660,384 | 8/1997 | Kovach et al. | 271/145 |
| 5,868,385 | 2/1999 | Embry et al. | 271/118 |

FOREIGN PATENT DOCUMENTS

| | | | |
|---|---|---|---|
| 405201557 | 8/1993 | Japan | B65H 1/12 |

*Primary Examiner*—William E. Terrell
*Assistant Examiner*—Kenneth Bower
*Attorney, Agent, or Firm*—John A. Brady

[57] ABSTRACT

A sheet support tray has its bottom support wall formed with a lower level planar portion and an upper level planar portion. The upper level planar portion extends from a reference edge a distance so that only one of two feed rollers can engage its sheet support surface, which has a last sheet restraint pad on it for engaging the one feed roller after the last sheet has been fed. The other feed roller cannot engage a last sheet restraint pad on the lower level planar portion so that narrow width sheets can be fed without skewing by the one feed roller.

10 Claims, 5 Drawing Sheets

TRAY FOR NARROW AND NORMAL WIDTH SHEETS

FIELD OF THE INVENTION

This invention relates to a sheet support tray and a sheet separator including the tray and, more particularly, to a sheet support tray capable of supporting narrow width sheets of a media for automatic feeding therefrom and a sheet separator including the tray.

BACKGROUND OF THE INVENTION

It has previously been suggested to use a tray or bin for supporting a stack of sheets of a media in which the uppermost sheet of the stack is advanced to a processing station for printing by a laser printer, for example. Feeding of the sheets of a media from a stack of sheets has been significantly improved by an auto compensating mechanism shown and described in U.S. Pat. No. 5,527,026 to Padget et al, which is incorporated by reference herein.

The auto compensating mechanism of the aforesaid Padget et al patent has utilized a pair of feed rollers, which are not centered with respect to the width of the stack of sheets. In a laser printer using the auto compensating mechanism of the aforesaid Padget et al patent for advancing each sheet in the stack to a processing station, each of the two feed rollers of the auto compensating mechanism of the aforesaid Padget et al patent has been disposed to be vertically aligned with a last sheet restraint pad. Each of the two feed rollers engages one of the last sheet restraint pads after the last sheet is fed.

The last sheet restraint pad has a long, narrow configuration to insure engagement by the vertically aligned feed roller when the tray is empty. When there are only two sheets remaining in the stack, the coefficient of friction between the last sheet restraint pad and the lowermost sheet in the stack enables the feed rollers to advance only the uppermost of the two sheets from the tray.

The location of the last sheet restraint pads in vertical alignment with the feed rollers has enabled very satisfactory feeding of sheets having a width for which the auto compensating mechanism is designed. However, this arrangement has prevented automatic feeding of narrow sheets from a stack, particularly where one of the last sheet restraint pads and the cooperating feed roller are positioned so that the feed roller could engage the last sheet restraint pad near the end of the feeding of the stack of sheets but before feeding is completed. That is, when the stack is relatively shallow, the feed roller, which is exterior of the periphery of the narrow width sheets of the stack, would engage the last sheet restraint pad. This would result in feeding of the narrow width sheets being stopped.

Accordingly, when automatically feeding various types of sheets of card stock in which it is desired to have a narrower width portion on which printing is to occur than the designed width of the tray, for example, it has been necessary to form the sheet of card stock of the same width as that for which the auto compensating mechanism of the aforesaid Padget et al patent is designed. That is, with 8½" by 11" paper being the designed size, for example, the sheet of the card stock would have to be this size with the portion in which printing is to occur having its periphery defined by perforations in the sheet. The perforations enable the removal of the printed portion from the remainder of the sheet of card stock after completion of printing following feeding of the sheet of card stock from the stack to a printer.

This is a significant waste of each sheet of media in addition to increasing the material cost. It also increases the production cost of each of the printed portions because of formation of the perforations in the card stock prior to loading in the tray. It also requires a person to remove the printed portion of the card stock from the remainder of the sheet of card stock after printing has occurred.

While manual feeding of narrow sheets of a media to a laser printer may be utilized, manual feeding of a large quantity of sheets is very time consuming because each sheet must be individually fed. Therefore, a card stock of narrow width has not been used with manual feeding since this is a more costly employee expense than to use a sheet of card stock of a standard size and have the previously described perforations formed around the portion to be printed. This same problem exists with other narrow width media such as labels, for example.

SUMMARY OF THE INVENTION

The foregoing problem of having to use a standard size sheet of card stock, for example, to produce a narrow width card stock or having a relatively expensive employee cost for manual feeding with a sheet of card stock of the desired narrow width is overcome by the sheet support tray of the present invention. It has been discovered that a narrow width of a sheet can be automatically fed by the auto compensating mechanism of the aforesaid Padget et al patent if the feed roller exterior of the periphery of the narrow width sheet is prevented from engaging the last sheet restraint pad with which it cooperates.

The tray of the present invention prevents the feed roller, which is exterior of the periphery of the narrow width sheet, from engaging the last sheet restraint pad through forming a bottom support wall of the tray with planar portions at two different levels. The upper level planar portion has its sheet support surface a distance of about 2 mm (the thickness of about twenty sheets of twenty pound paper) above the sheet support surface of the lower level planar portion.

The upper level planar portion is positioned in a corner of the tray adjacent an inclined wall against which the forward edge of each of the sheets of media is disposed. This arrangement results in only one of the two feed rollers feeding a narrow width sheet of a desired size without affecting the auto compensating mechanism of the aforesaid Padget et al patent. The other feed roller cannot engage the last sheet restraint pad beneath it because the lowermost surface of the other feed roller is in the plane of the sheet support surface of the upper level planar portion and the last sheet restraint pad is supported at the lower level planar portion.

An object of this invention is to provide a sheet support tray for supporting sheets of a media in which both sheets of a designed width for the tray and sheets of a narrower width may be automatically fed from the tray.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
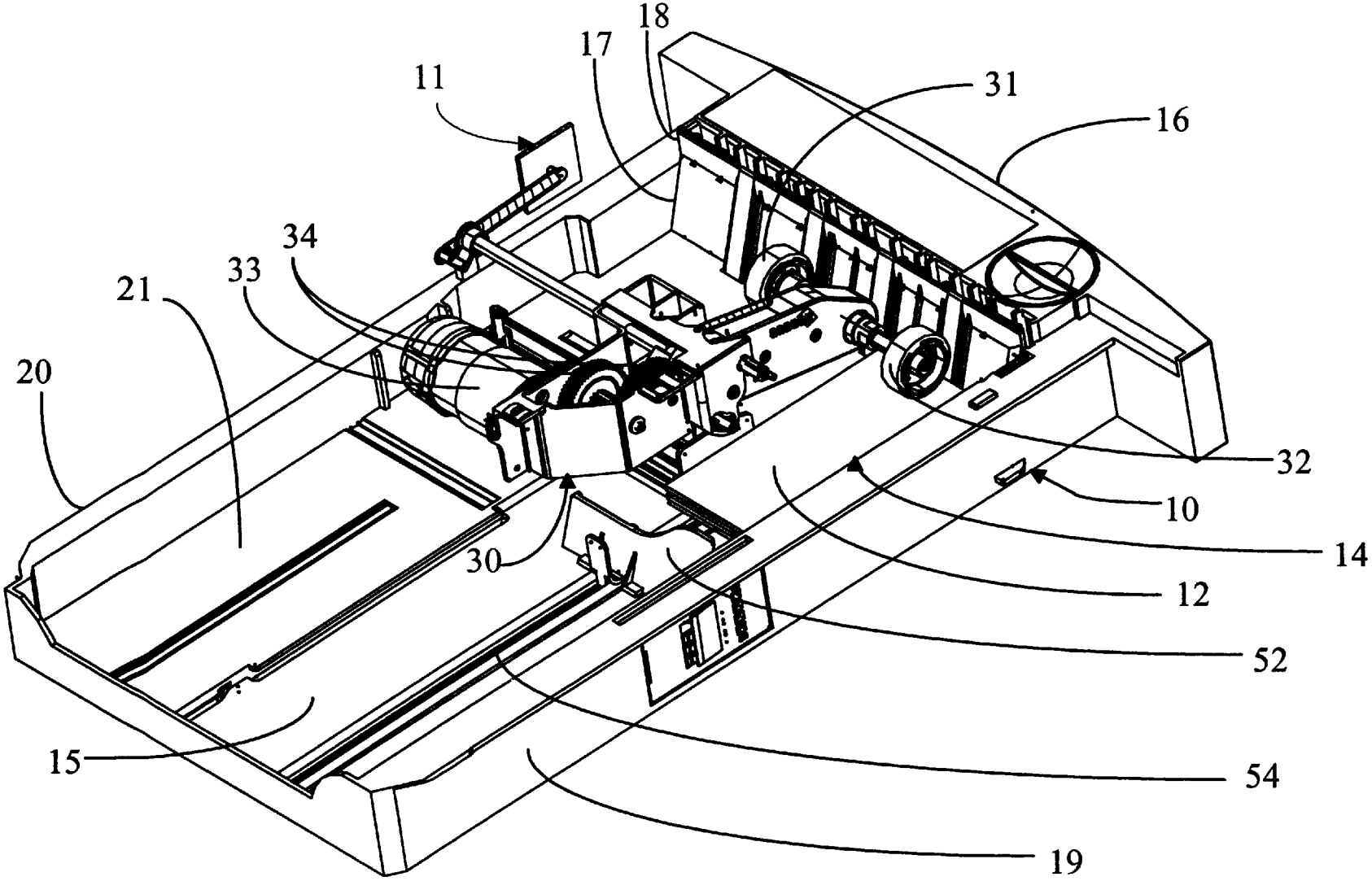
FIG. 1 is a perspective view of a sheet support tray of the present invention having a stack of sheets of media therein for advancement by an auto compensating mechanism with the sheets shown enlarged for clarity purposes.

Referring to the drawings and particularly FIG. 1, there is shown a tray 10 used in a printer 11. The tray 10 supports a plurality of sheets 12 of a media such as card stock, for example, in a stack 14. The sheets 12 may be other media such as bond paper, labels, or envelopes, for example.

The tray 10 has a bottom wall 15 supporting the stack 14 of the sheets 12 therein. Adjacent its front end 16, the tray 10 has an inclined wall 17 integral with the bottom wall 15 of the tray 10.

The wall 17 is inclined at an obtuse angle to the bottom wall 15 of the tray 10 and to the adjacent end of the stack 14 of the sheets 12. The inclined or angled wall 17 constitutes a portion of a dam against which each of the sheets 12 in the stack 14 is advanced into engagement. The dam also includes a vertical wall 18 above the inclined wall 17. The sheet 12 is advanced from the vertical wall 18 towards a processing station of the printer 11 at which printing occurs.

Figure 2:
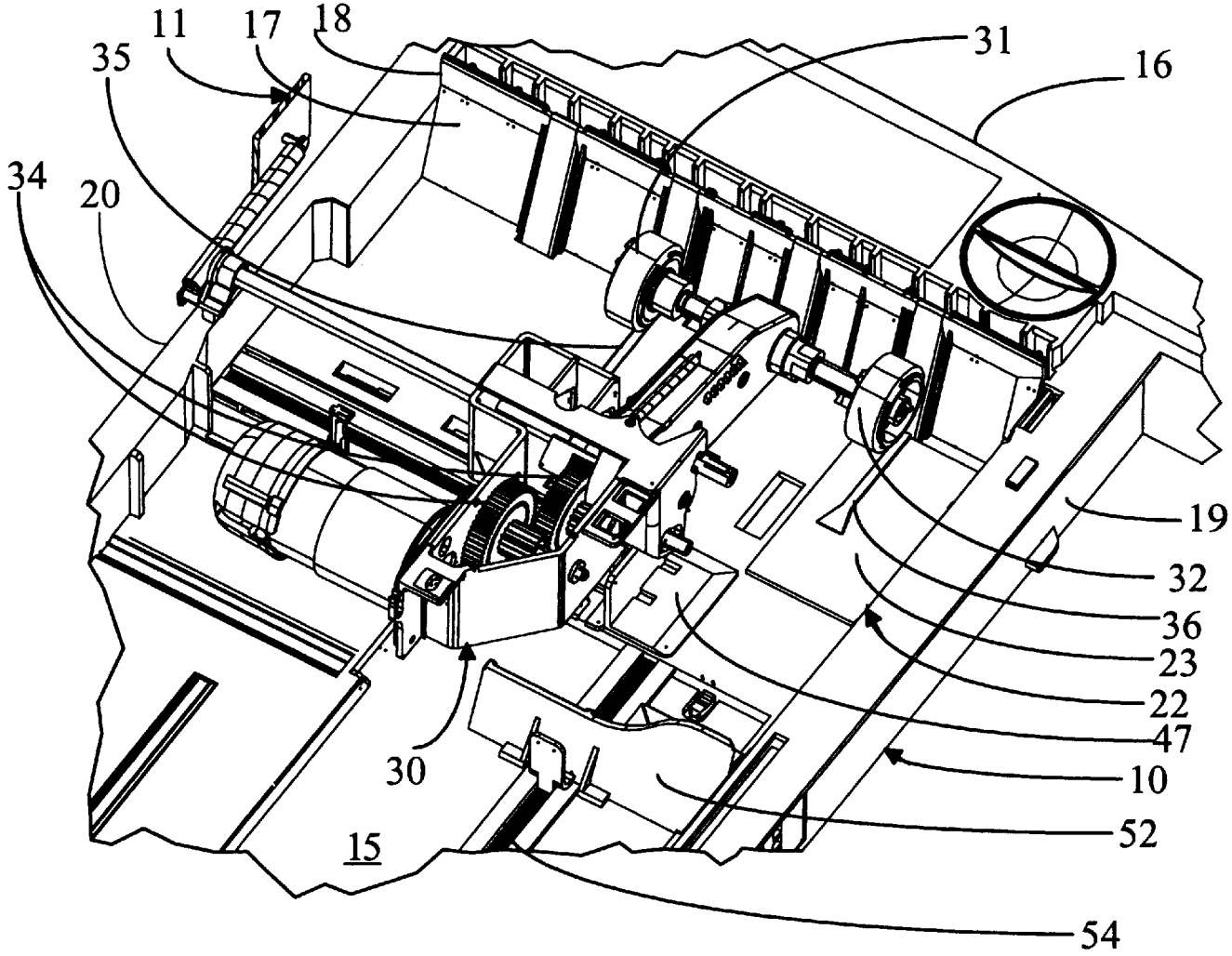
FIG. 2 is an enlarged perspective view of a portion of the tray of FIG. 1 without any sheets of media therein.

The bottom wall 15 extends between substantially parallel side walls 19 and 20 of the tray 10. The bottom wall 15 has its surface constituting a lower planar portion 21 having a pick plate 22 (see FIG. 2), which is preferably rectangular shaped, fixed thereto in the area adjacent the intersection of the side wall 19 and the inclined wall 17.

The pick plate 22 constitutes an upper planar portion of the bottom wall 15 having its upper surface 23 above the sheet support surface of the lower planar portion 21. The pick plate 22 has pins (not shown) extending downwardly from its bottom surface 24 (see FIG. 3) for disposition within holes 26 in the bottom wall 15. The pins (not shown), which extend downwardly from the bottom surface 24 of the pick plate 22, are secured in the holes 26 by hot upset.

The thickness of the pick plate 22 is about 2 mm, which is the thickness of about twenty sheets of twenty pound paper. Thus, the upper surface 23 of the pick plate 22 is about 2 mm above the bottom wall 15. Each of the sheets 12 (see FIG. 1) is advanced from the stack 14 by an auto compensating mechanism 30 of the type described in the aforesaid Padget et al patent.

The auto compensating mechanism 30 includes a pair of feed rollers 31 and 32, which are driven from a motor 33 through a gear train 34. The auto compensating mechanism 30 is more particularly shown and described in the copending application of D. M. Gettelfinger et al, which is incorporated by reference herein, for "Sheet Separator Dam With Inset Friction Element," Ser. No. 08/919,551, filed Aug. 28, 1997, and assigned to the same assignee as this application. The motor 33 is alternately turned off and on by control means (not shown) as each of the sheets 12 is advanced from the top of the stack 14 of the sheets 12.

The planar portion 21 has a last sheet restraint pad 35 (see FIG. 3) therein and extending slightly above the surface of the planar portion 21. The pick plate 22 has a last sheet restraint pad 36 in the upper surface 23 and extending slightly above the surface 23. Each of the last sheet restraint pads 35 and 36 is formed of a suitable high friction material such as rubber, for example.

Figure 4:
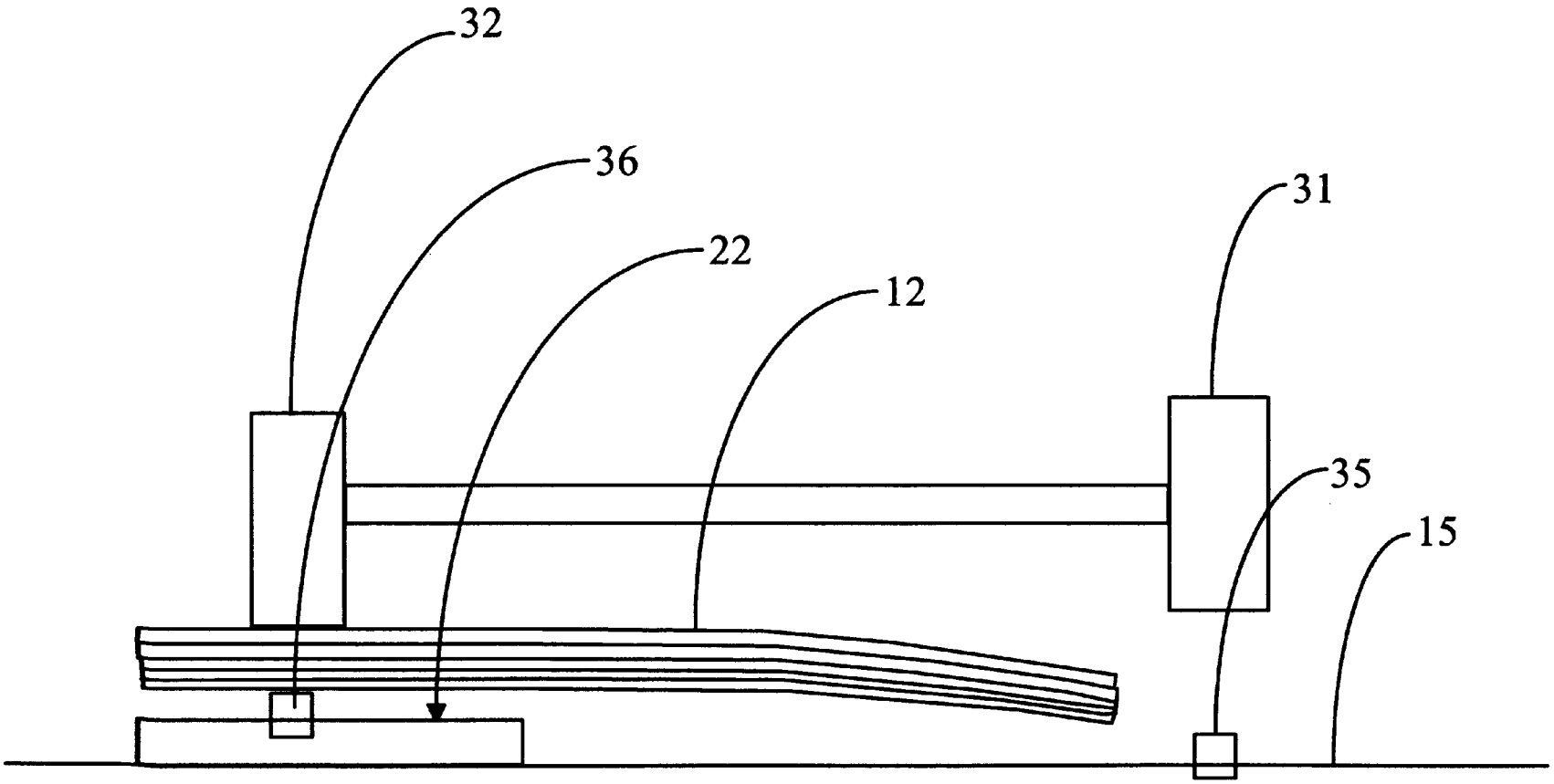
FIG. 4 is a schematic view showing the relationship of two feed rollers, two last sheet restraint pads, and two levels of the bottom wall of the tray of FIG. 1 with sheets of a width to be engaged by only one of the feed rollers of the auto compensating mechanism.

As shown in FIG. 4, the feed roller 31 is disposed above the last sheet restraint pad 35, and the feed roller 32 is disposed above the last sheet restraint pad 36. When the sheets 12 have a narrow width as shown in FIG. 4 whereby they do not extend underneath the feed roller 31, the feed roller 31 cannot engage the last sheet restraint pad 35 even when the last of the sheets 12 is being advanced by the feed roller 32.

If the feed roller 31 could engage the last sheet restraint pad 35 at any time, then the sheets 12, which have a narrow width so that they do not extend over the last sheet restraint pad 35, could not be advanced because the auto compensating mechanism 30 (see FIG. 2) would be stopped due to the feed roller 31 not rotating and software of the auto compensating mechanism 30 sensing such. However, because of the upper surface 23 of the pick plate 22 being elevated above the bottom wall 15, there is no contact of the feed roller 31 with the last sheet restraint pad 35. Accordingly, feeding of the sheets 12 (see FIG. 1) occurs only by the feed roller 32 so that feeding of the sheets 12 of the narrow width is not stopped.

When the sheets 12 have a width so that they extend beneath the feed roller 31 and the resisting force of the dam is sufficient to increase the normal force of the feed roller 31 to the sheets 12, then both of the feed rollers 31 and 32 feed each of the sheets 12. Thus, when the sheets 12 have the designed width between the side walls 19 and 20 of 8 ½", each is easily fed by the feed rollers 31 and 32 without skewing. This occurs even though the upper surface 23 (see FIG. 2) of the pick plate 22 is disposed higher than the bottom wall 15 to which the pick plate 22 is attached. The sheets 12 (see FIG. 1) will merely bend to also rest on the last sheet restraint pad 35 (see FIG. 3) and the lowermost of the sheets 12 (see FIG. 1) will be held thereagainst by the feed roller 31 when there is a sufficient number of the sheets 12 in the stack 14.

The side wall 19 (see FIG. 3) of the tray 10 has a plurality of substantially parallel ribs 40 on its inner surface functioning as a reference guide edge for a side edge of each of the sheets 12 (see FIG. 1) irrespective of the width. The sheets 12 are held against the ribs 40 (see FIG. 3) by a retainer 41.

The retainer 41 is slidably mounted on a U-shaped rail 42, which is disposed in a recess 43 in the bottom wall 15 of the tray 10. The rail 42 has teeth 44 cooperating with a holding pawl 45 on the retainer 41 to hold the retainer 41 in any position to which it is moved. The pawl 45 is supported on a vertical wall 46, which bears against a side edge of the sheets 12 (see FIG. 1), of the retainer 41 (see FIG. 3). Thus, the retainer 41 insures that a side edge of each of the sheets 12 (see FIG. 1) is held against the ribs 40 (see FIG. 3). The retainer 41 has a foot 47 disposed beneath the lowermost of the sheets 12 (see FIG. 1).

Figure 3:
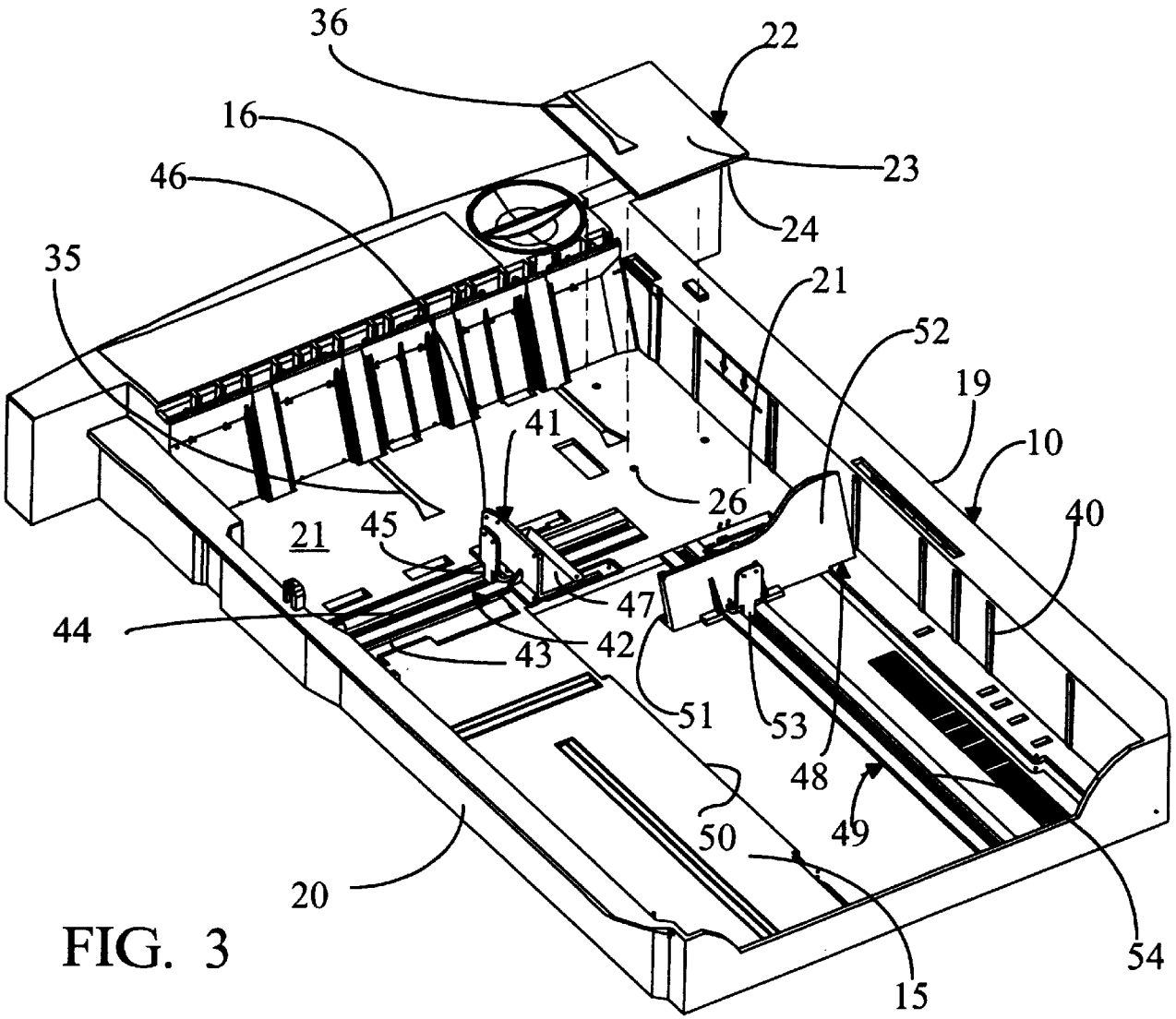
FIG. 3 is a perspective view of the tray of FIG. 1 without the auto compensating mechanism and with a pick plate in an exploded position to show its mounting arrangement.

The sheets 12 have their leading edges held against the inclined wall 17 of the is tray 10 by a retainer 48 (see FIG. 3). The retainer 48 is slidably mounted on a U-shaped rail 49, which is mounted in a recess 50 in the bottom wall 15.

The retainer 48 has a foot 51 for disposition beneath the lowermost of the sheets 12 (see FIG. 1) of the stack 14. The retainer 48 (see FIG. 3) has an inclined wall 52 for engaging the rear edge of each of the sheets 12 (see FIG. 1) in the stack 14. A holding pawl 53 (see FIG. 3) is supported on the inclined wall 52 and engages teeth 54 in the bottom of the U-shaped rail 49. Therefore, the retainer 48 is retained in any desired position to which it is moved.

Accordingly, the tray 10 (see FIG. 1) has the two planar portions providing two levels of support for the stack 14 of the sheets 12. The sheets 12 may be of any width and still be advanced without skewing. When the sheets 12 do not extend underneath the feed roller 31 as shown in FIG. 4, the sheets 12 are advanced only by the feed roller 32. Because of the elevation of the feed roller 31, the feed roller 31 cannot engage the last sheet restraint pad 35 when the sheets 12 are not disposed beneath the feed roller 31. If the feed roller 31 were to engage the last sheet restraint pad 35, then feeding of the sheets 12 by the feed roller 32 would cease because the printer 11 would sense that the feed roller 31 is not freely rotating to incorrectly indicate that the sheets 12 cannot be advanced.

Figure 5:
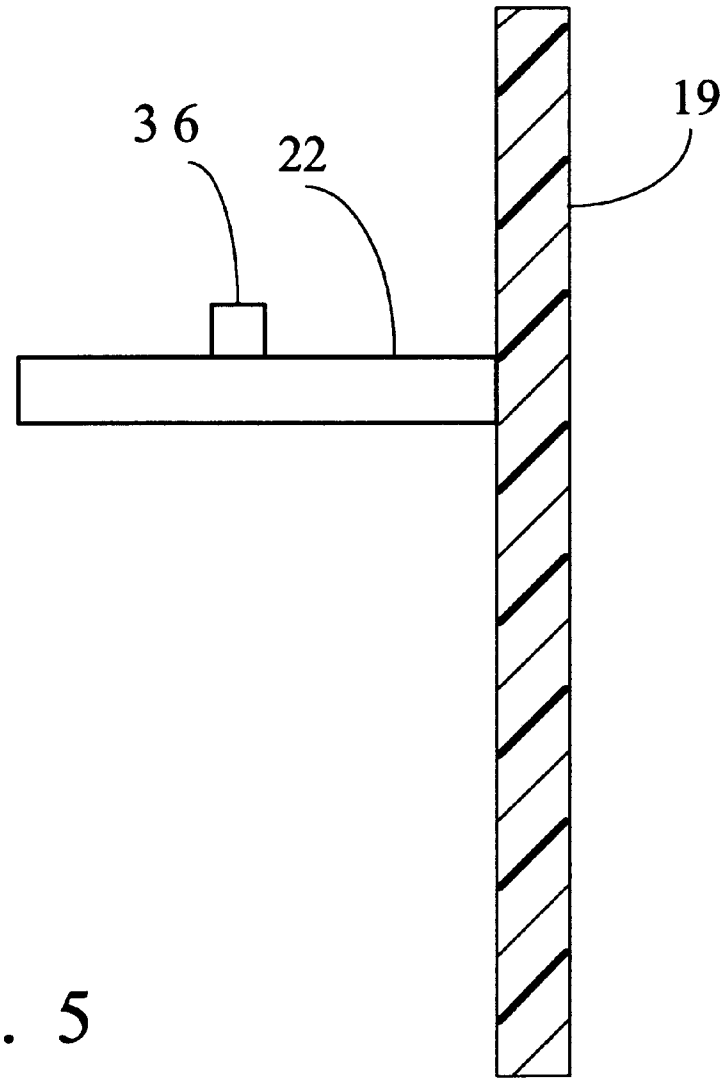
FIG. 5 is a fragmentary elevational view, partly in section, of a modification in which a pick plate is supported by a side wall of the tray of FIG. 1.

It is not necessary for the pick plate 22 to be fixed to the bottom wall 15. Instead, as shown in FIG. 5, the pick plate 22 may be supported by the side wall 19. Instead of the pick plate 22 being separate from the bottom wall 15 (see FIG. 2) and then attached thereto, it should be understood that the bottom wall 15 could be formed with the upper planar portion, which is defined by the pick plate 22, being thicker than the remainder of the bottom wall 15.

It should be understood that the coefficient of friction between the sheets 12 (see FIG. 1) and the pick rollers 31 and 32 or only the pick roller 32 depending upon the width of the sheets 12 is greater than the coefficient of friction between the adjacent sheets 12 of the stack 14. The coefficient of friction between the lowermost sheet 12 of the stack 14 and the last sheet restraint pads 35 and 36 is greater than that between the adjacent sheets 12 but not greater than the coefficient of friction between the feed rollers 31 and 32 and the uppermost sheet 12 of the stack 14.

An advantage of this invention is that there can be automatic feeding from a stack of sheets of any width equal to or greater than a width that disposes the sheets beneath one of the feed rollers. Another advantage of this invention is that it is not necessary to use a standard width sheet to print on a narrow width sheet.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A sheet support tray for supporting a stack of sheets of a media from which each of the sheets is to be fed separately including:

a bottom wall for supporting the stack of sheets;

substantially parallel side walls extending upwardly from opposite sides of said bottom wall;

said bottom wall including a lower planar portion and an upper planar portion disposed a predetermined distance above said lower planar portion, said upper planar portion being smaller than said lower planar portion so that the stack of sheets rests on at least said upper planar portion and on both said lower planar portion and said upper planar portion depending on the dimensions of the stack of sheets;

one of said side walls having a reference guide edge against which an edge of each of the sheets of the stack of sheets engages;

an inclined wall extending between said side walls and against which each sheet is advanced from the stack of sheets;

each of said lower planar portion and said upper planar portion having a last sheet restraint pad for cooperating with a separate feed roller of sheet advancing means for advancing the uppermost of the sheets from the stack of sheets against said inclined wall;

said upper planar portion extending from said one side wall a distance less than the position of said last sheet restraint pad of said lower planar portion from said one side wall;

and movable holding means for engaging the rear and the side, remote from said one side wall, of the stack of sheets of media for holding the stack of sheets for engagement of the uppermost sheet by at least the separate feed roller of the sheet advancing means that cooperates with said last sheet restraint pad on said upper planar portion.

2. The tray according to claim 1 in which:

said upper planar portion is adjacent said one side wall;

said upper planar portion extends rearwardly from said inclined wall;

and said upper planar portion extends from said one side wall substantially less than the width of said bottom wall.

3. The tray according to claim 1 in which:

said lower planar portion of said bottom wall extends between said side walls;

said upper planar portion is supported by said lower planar portion;

and said upper planar portion overlies a relatively small area of said lower planar portion.

4. The tray according to claim 1 in which:

said lower planar portion of said bottom wall extends between said side walls;

said upper planar portion is a plate supported by said lower planar portion;

and said plate extends rearwardly from said inclined wall and extends for only a relatively short distance from said one side wall.

5. The tray according to claim 4 in which said plate is rectangular shaped.

6. A sheet separator for advancing the uppermost sheet of a stack of sheets of media from the stack of sheets including:

sheet advancing means for advancing the uppermost sheet from the stack of sheets;

said sheet advancing means including at least two feed rollers for engaging the uppermost sheet of the stack of sheets to advance the uppermost sheet from the stack of sheets;

and a sheet support tray including:

a bottom wall for supporting the stack of sheets;

substantially parallel side walls extending upwardly from opposite sides of said bottom wall;

said bottom wall including a lower planar portion and an upper planar portion disposed a predetermined distance above said lower planar portion;

one of said side walls having a reference guide edge against which an edge of each of the sheets of the stack of sheets engages;

an inclined wall extending between said side walls and against which each sheet is advanced from the stack of sheets by said sheet advancing means;

each of said lower planar portion and said upper planar portion having a last sheet restraint pad for cooperating with one of said feed rollers of said sheet advancing means;

said upper planar portion extending from said one side wall a distance less than the position of said last sheet restraint pad of said lower planar portion from said one side wall;

and movable holding means for engaging the rear edge and the side edge, remote from said one side wall, of the stack of sheets of media for holding the stack of sheets for engagement of the uppermost sheet by at least said one feed roller of said sheet advancing means.

7. The sheet separator according to claim 6 in which:

said upper planar portion is adjacent said one side wall;

said upper planar portion extends rearwardly from said inclined wall;

and said upper planar portion extends from said one side wall substantially less than the width of said bottom wall.

8. The sheet separator according to claim 6 in which:

said lower planar portion of said bottom wall extends between said side walls;

said upper planar portion is supported by said lower planar portion;

and said upper planar portion overlies a relatively small area of said lower planar portion.

9. The sheet separator according to claim 6 in which:

said lower planar portion of said bottom wall extends between said side walls;

said upper planar portion is a plate supported by said lower planar portion;

and said plate extends rearwardly from said inclined wall and extends for only a relatively short distance from said one side wall.

10. The sheet separator according to claim 9 in which said plate is rectangular shaped.

* * * * *